US005664554A

United States Patent [19]

Martin

[11] Patent Number: 5,664,554

[45] Date of Patent: Sep. 9, 1997

[54] HEAT GUARD

[76] Inventor: Brett D. Martin, 525 Bethany Rd., Covington, Ga. 30209

[21] Appl. No.: 680,457

[22] Filed: Jul. 15, 1996

[51] Int. Cl.[6] ..... F24C 15/36

[52] U.S. Cl. ..... 126/201; 126/42; 160/352

[58] Field of Search ..... 126/42, 39 R, 126/201, 202, 211, 215, 214 R, 190; 160/352, DIG. 9, 351, 368.1

[56] References Cited

U.S. PATENT DOCUMENTS 4,527,540 7/1985 Ryan et al. ..... 126/42

5,117,807 6/1992 Graulich ..... 126/190

FOREIGN PATENT DOCUMENTS 0298858 1/1989 European Pat. Off. ..... 126/42

1805 of 1889 United Kingdom ..... 126/201

2241777 9/1991 United Kingdom ..... 126/201

*Primary Examiner*—James C. Yeung

*Attorney, Agent, or Firm*—David L. Volk; Brendan B. Dix

[57] ABSTRACT

A main member includes two opposing sides and a first end which is dipsosed opposite a second end. A side member depends from each of the sides. A handle insert depends from the first end, the handle insert configured to fit over a handle of an oven door. The side members are configured to extend along the sides of the oven.

1 Claim, 2 Drawing Sheets

HEAT GUARD

BACKGROUND—FIELD OF THE INVENTION

This invention relates to protective covers, specifically to a device which covers an oven door to protect persons from injury from touching a hot surface.

BACKGROUND—DESCRIPTION OF PRIOR ART

Typically, the temperature inside an oven ranges from 350 to 450 degrees during operation. It is difficult to insulate an oven door enough to bring the temperature of the outside surface of the door down to a suitable temperature which would not cause harm to an individual who touches it. A hot oven door can be particularly hazardous to a child, who because of his or her size and explorative, active nature is more likely than an adult to come into contact with the door.

What is needed is a method of protecting children from injury from touching a hot oven door.

SUMMARY

The heat guard of the present invention includes a main member having two opposing sides and a first end which is dipsosed opposite a second end. A side member depends from each of the sides. A handle insert depends from the first end, the handle insert configured to fit over a handle of an oven door. The side members are configured to extend along the sides of the oven.

DETAILED DESCRIPTION

Figure 1:
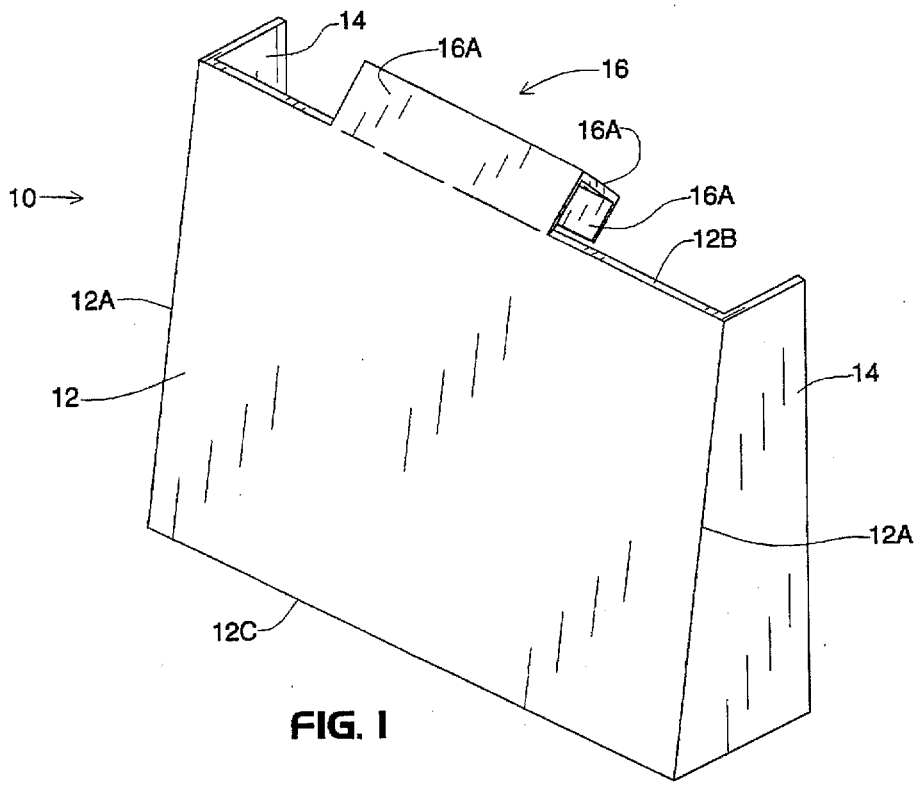
FIG. 1 is a front perspective view of the heat guard.

FIG. 1 is a front perspective view of a heat guard 10. The heat guard 10 includes a broad, substantially rectangular, planar main member 12. The main member 12 includes two opposing sides 12A, and a first end 12B which is disposed opposite a second end 12C. The main member is mined at each of the sides 12A to form two planar side members 14. A handle insert 16 depends outwardly from the first end 12B of the main member 12. The handle insert 16 comprises three connecting substantially rectangular planar insert members 16A, each forming a substantially right angle with its adjacent insert member 16A, such that the handle insert 16 is substantially hook shaped. The insert member 16A that is connected to the main member 12 forms an acute angle with the plane of the main member 12.

Figure 2:
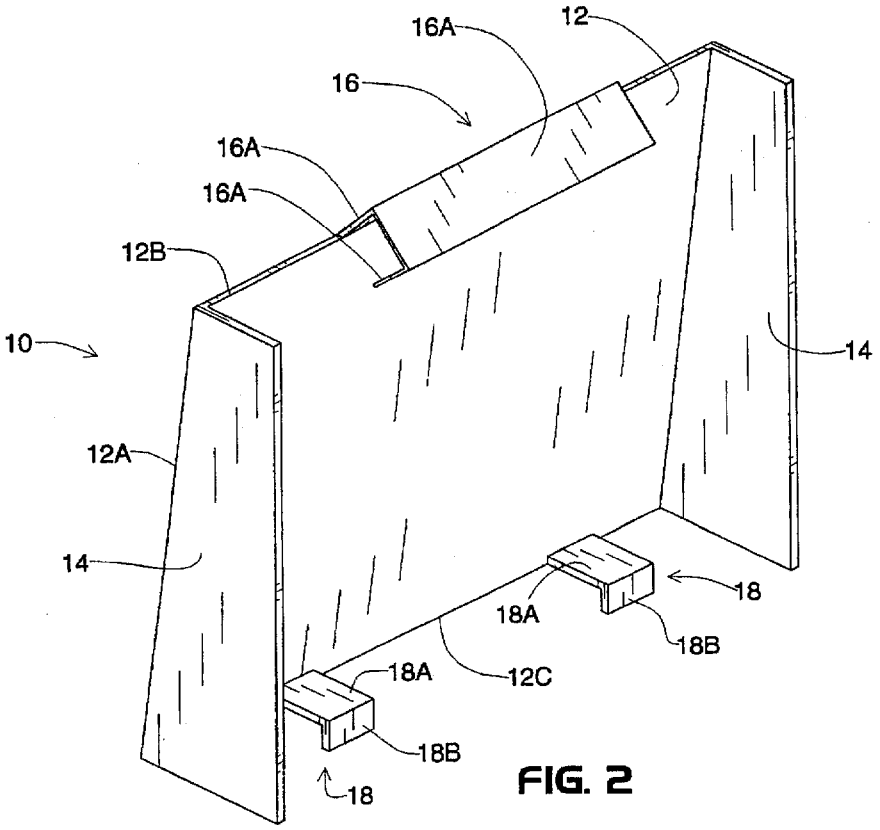
FIG. 2 is a rear perspective view of the heat guard.

FIG. 2 is a rear perspective view of the heat guard 10. Two substantially L-shaped hook members 18 depend outwardly from the second end 12C of the main member 12 in the same direction as the side members 14 depend from the sides 12A.

Figure 3:
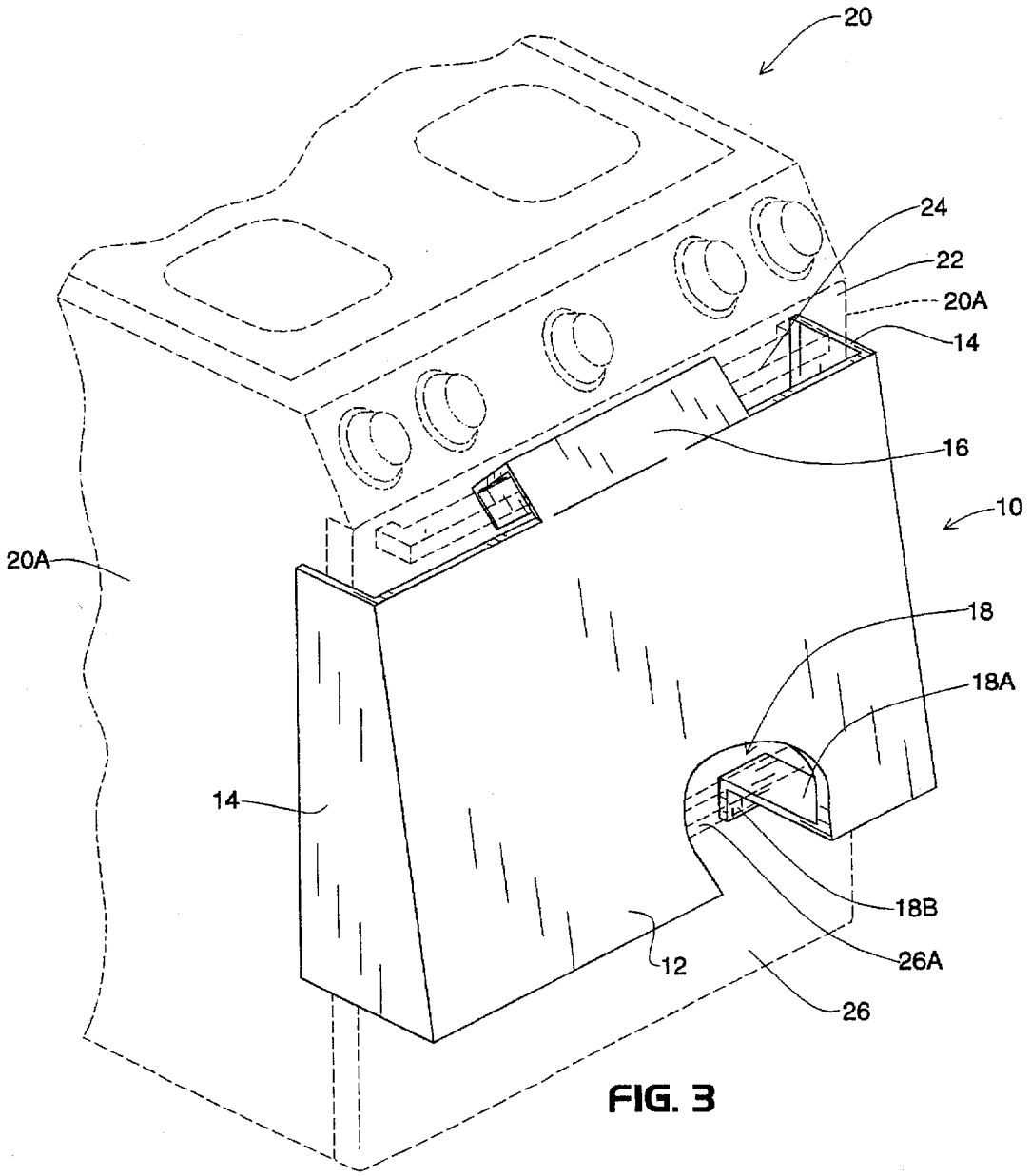
FIG. 3 is a perspective view of the heat guard in use on an oven door.

FIG. 3 is a perspective view of the heat guard 10 in use on an oven 20. The oven 20 includes oven sides 20A, an oven door 22 with a handle 24 there-on and a drawer 26 below the door 22. The handle insert 16 is fitted over the handle 24 and the side members 14 extend along the oven sides 20A at least enough to cover the thickness of the oven door 22. Friction between the side members 14 and the oven sides 20A tends to hold the main member 12 away from the oven door 22, creating an air space therebetween.

A portion of the main member 12 is shown broken away to show the hook members 18, which are configured such that a first leg 18A of the member 18 extends over the top 26A of the drawer 26 and a second leg 18B extends down into the drawer 26.

To install the heat guard 10 on the oven 20, the drawer 26 is opened part-way, then the handle insert 16 is placed over the handle 24 and the side members 14 are aligned with the oven 20 such that the side members 14 extend along the oven sides 20A. At this time, the hook members 18 are positioned below the oven door 22. The drawer 26 is then closed to capture the hook members 18 within the closed drawer 26.

The heat guard 10 is constructed of relatively non-heat-conductive material. For example, heat resistant plastic is preferred over metal.

Thus the heat guard 10 of the present invention protects children from injury from touching the hot surface of the oven door 22. The air space between the door 22 and the main member 12 insulates the main member 12 from the heat of the door 22, and provides a surface which is relatively much cooler to the touch than the oven door 22. The hook members 18 when placed in position over the top 26A of the drawer 26 help to secure the heat guard 10 in place, to ensure that it is not inadvertently removed from the door 22.

While the above description contains many specific details, these should not be construed as limitations on the scope of the invention, but rather as an exemplification of one embodiment thereof. Many variations are possible, for example:

a. reflective material and/or insulation may be used on portions of the heat guard 10 which abut or face the oven 20;

b. the handle insert 16 may be configured differently, such as having generally rounded or curved construction;

c. the side members 14 may stop flush with the oven door 22 instead of extending along the sides 20A of the oven 20;

d. the hook members 18 may be deleted; and e. structure may be added to the heat guard 10 to contribute to maintaining a distance between the main member 12 and the oven door 22.

Accordingly, the scope of the invention should be determined not by the embodiment illustrated, but by the appended claims and their legal equivalents.

The invention claimed is:

1. A protective guard for an oven, such an oven having oven sides and an oven door, such an oven door having a handle thereon and a drawer below, the guard comprising:

a. a main member having two opposing sides and a first end opposite a second end;

b. a side member depending from each of the sides;

c. a handle insert depending from the first end, the handle insert configured to fit over such a handle;

d. the side members configured to extend along such oven sides when the handle insert is fitted over such a handle; and e. at least one hook member depending outwardly from the second end in the same direction as the side members depend from the sides, each hook member configured to engage such a drawer when the handle insert is fitted over such a handle.

* * * * *